US005384037A

United States Patent [19]

Kalnes

[11] Patent Number: 5,384,037

[45] Date of Patent: Jan. 24, 1995

[54] INTEGRATED PROCESS FOR THE PRODUCTION OF DISTILLATE HYDROCARBON

[75] Inventor: Tom N. Kalnes, La Grange, Ill.

[73] Assignee: UOP, Des Plaines, Ill.

[21] Appl. No.: 83,227

[22] Filed: Jun. 29, 1993

Related U.S. Application Data

[63] Continuation-in-part of Ser. No. 752,805, Aug. 30, 1991, abandoned.

[51] Int. Cl.[6] ..... C10G 49/00; C10G 69/14

[52] U.S. Cl. ..... 208/85; 208/86; 208/92; 208/110; 208/144; 208/184; 208/185; 208/186; 208/212; 208/254 H

[58] Field of Search ..... 208/58, 85, 86, 92, 208/110, 144, 145, 184, 185, 186, 212, 254 H

[56] References Cited

U.S. PATENT DOCUMENTS 3,340,182 9/1967 Berkman et al. ..... 208/212
4,372,842 2/1983 Gardner ..... 208/254
4,882,037 11/1989 Kalnes et al. ..... 208/85

*Primary Examiner*—Helen M. S. Sneed
*Assistant Examiner*—Walter D. Griffin
*Attorney, Agent, or Firm*—Thomas K. McBride; John G. Tolomei; John G. Cutts, Jr.

[57] ABSTRACT

A process for the production of a distillable hydrocarbon product stream from a first distillate hydrocarbon stream, a second distillate hydrocarbon stream and a waste lubricant stream by means of contacting the waste lubricant stream with a hot hydrogen-rich gaseous stream to increase the temperature of this feed stream and vaporize at least portion of the distillable hydrocarbonaceous compounds thereby producing a distillable hydrocarbonaceous stream which is immediately hydrogenated in an integrated hydrogenation zone. The vaporized waste oil stream is admixed with a first distillate hydrocarbon stream before introduction into the hydrogenation zone. The second distillate hydrocarbon stream is converted in a hydrocracking conversion zone in order to produce lower boiling distillable hydrocarbon products and an aqueous ammonia solution which is admixed with a partially condensed effluent from the hydrogenation zone in order to neutralize at least one acid gas. The resulting admixture is partially condensed to produce a hydrogen-rich gaseous stream and a distillable hydrocarbon product stream.

13 Claims, 1 Drawing Sheet

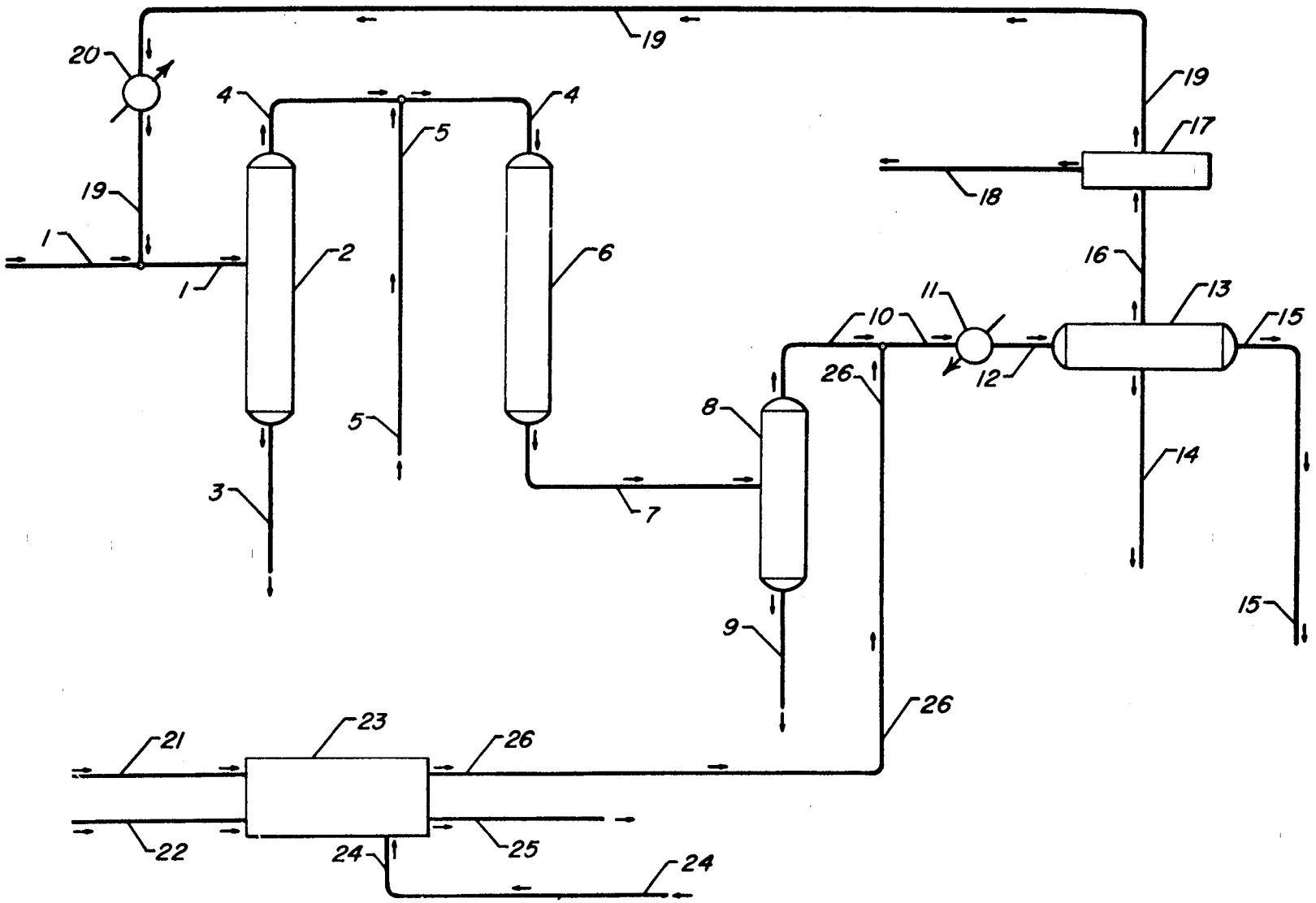
1
2
3
4
5
6
7
8
9
10
11
12
13
14
15
16
17
18
19
20
21
22
23
24
25
26

INTEGRATED PROCESS FOR THE PRODUCTION OF DISTILLATE HYDROCARBON

CROSS REFERENCE TO RELATED APPLICATION

This application is a continuation-in-part of U.S. Ser. No. 07/752,805 filed Aug. 30, 1991 now abandoned, all of which is incorporated by reference.

BACKGROUND OF THE INVENTION

The field of art to which this invention pertains is the production of a distillable hydrocarbon stream from a first distillate hydrocarbon stream, a second distillate hydrocarbon stream and a waste lubricant stream. The waste lubricant stream is contacted with a hot hydrogen-rich gaseous stream to increase the temperature of this feed stream and to vaporize at least a portion of the distillable hydrocarbonaceous compounds, thereby producing a distillable hydrocarbonaceous stream which is immediately hydrogenated in an integrated hydrogenation zone. The vaporized waste oil stream is admixed with a first distillate hydrocarbon stream before introduction into the hydrogenation zone. The second distillate hydrocarbon stream is convened in a hydrocracking conversion zone in order to produce lower boiling distillable hydrocarbon products and an aqueous ammonia solution. The aqueous ammonia solution is then admixed with a partially condensed effluent from the hydrogenation zone in order to neutralize at least one acid gas. The resulting admixture is partially condensed to produce a distillable hydrocarbon product stream and a hydrogen-rich gaseous stream which is preferably recycled to contact the waste lubricant feedstock.

There has always been a demand for high quality distillate hydrocarbon and recently there is a steadily increasing demand for technology which is capable of reclaiming and of rerefining waste lubricants. Previous techniques utilized to dispose of waste lubricants which are frequently contaminated with halogenated organic compounds and other heteroatomic compounds have frequently become environmentally unpopular or illegal and, in general, have always been expensive. With the increased environmental emphasis for the treatment and recycle of chlorinated organic compounds and waste lubricants, there is an increased need for the conversion of these products when they become spent and unwanted. For example, large quantities of used motor oil are generated and discarded which oil would provide a large potential supply of feedstock for the present invention while providing an environmentally responsible disposal. Therefore, those skilled in the art have sought to find feasible techniques to convert such feedstocks to produce hydrocarbonaceous product streams which may be safely and usefully employed or recycled. Previous techniques which have been employed include incineration and dumping which, in addition to potential pollution considerations, fail to recover valuable hydrocarbonaceous materials.

INFORMATION DISCLOSURE

In U.S. Pat. No. 4,882,037 (Kalnes et al), a process is disclosed for treating a temperature-sensitive hydrocarbonaceous stream containing a non-distillable component and a distillable, hydrogenatable hydrocarbonaceous fraction to produce a selected hydrogenated distillable light hydrocarbonaceous product, a distillable heavy hydrocarbonaceous liquid product and a heavy product. The '037 patent teaches the flashing of a hydrocarbonaceous stream containing a non-distillable component and the partial condensing of at least a portion of the flashed overhead stream to produce a heavy hydrocasbonaceous product stream which is removed from the process before the remaining portion of the flashed overhead stream is introduced into the hydrogenation reaction zone.

In U.S. Pat. No. 4,372,842, a process is disclosed for the catalytic hydrocracking, hydrodesulfurization and/or hydrodenitrogenation of organic compounds in the presence of a catalyst. Although the '842 patent discloses the concomitant production of ammonia with hydrocracking, the main thrust of the patent is to describe a catalyst composition which is extremely resistant to poisoning by ammonia or hydrogen sulfide. The '842 patent considers the production of ammonia as a by-product, at best, or a nuisance in the worst case, and does not contemplate or teach any further use of such an ammonia stream.

BRIEF SUMMARY OF THE INVENTION

The invention provides an integrated process for the production of a distillate hydrocarbon stream from a first distillate hydrocarbon stream, a second distillate hydrocarbon stream and a waste lubricant stream by means of contacting the waste lubricant stream with a hot hydrogen-rich gaseous stream to increase the temperature of this feed stream to vaporize at least a portion of the distillable hydrocarbonaceous compounds thereby producing a distillable hydrocarbonaceous stream which is immediately hydrogenated in an integrated hydrogenation zone. The first distillate hydrocarbon stream is also introduced into the integrated hydrogenation zone. The resulting effluent from the integrated hydrogenation zone is partially condensed and separated to produce a distillable hydrocarbon stream and a hydrogen-rich gaseous hydrocarbon stream containing an acid gas. An aqueous ammonia solution which is produced in an integrated hydrocracking zone is admixed with the hydrogen-rich gaseous hydrocarbon stream containing an acid gas and the resulting admixture is partially condensed to produce a hydrogen-rich gas stream, a distillable hydrocarbon product and a spent aqueous stream. Important elements of the improved process are the relatively short time that the waste oil stream is maintained at an elevated temperature, the avoidance of heating the waste oil stream via indirect heat exchange to preclude the coke formation that would otherwise occur, the ability to simultaneously recover various streams of high quality distillable hydrocarbonaceous compounds, and the utilization of the waste aqueous ammonia solution from the hydrocracking zone to neutralize the acid gas which is produced in the integrated hydrogenation reaction zone.

One embodiment of the invention may be characterized as an integrated process for the production of a distillable hydrocarbon stream from a first distillate hydrocarbon stream, a second distillate hydrocarbon stream and a waste lubricant stream which process comprises: (a) contacting the waste lubricant stream with a first hydrogen-rich gaseous stream in a flash zone at flash conditions thereby increasing the temperature of the waste lubricant stream to produce a hydrocarbonaceous vapor stream comprising hydrogen and a non-distillable component; (b) admixing the hydrocarbonaceous vapor stream comprising hydrogen and the first distillate hydrocarbon feed stream and contacting the resulting admixture with a hydrogenation catalyst in a hydrogenation reaction zone at hydrogenation conditions; (c) condensing at least a portion of the resulting effluent from the hydrogenation reaction zone to produce a second hydrogen-rich gaseous stream comprising at least one acid gas and a first distillable hydrocarbon product stream; (d) contacting the second distillate hydrocarbon stream with a hydrocracking catalyst in a hydrocracking zone at hydrocracking conditions; (e) recovering a second distillable hydrocarbon product stream and an aqueous ammonia solution from the hydrocracking zone; (f) admixing the aqueous ammonia solution recovered in step (e) with the second hydrogen-rich gaseous stream comprising at least one acid gas recovered from step (c); and (g) condensing at least a portion of the admixture produced in step (f) to produce a third hydrogen-rich gaseous stream and a third distillable hydrocarbon product stream.

Other embodiments of the present invention encompass further details such as preferred feedstocks, hydrogenation catalysts, hydrocarbon conversion catalysts and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

The present invention provides an improved integrated process for the production of distillate hydrocarbon from a first distillate hydrocarbon stream, a second distillate hydrocarbon stream and a waste lubricant stream.

In accordance with the process of the present invention a wide variety of heavy distillate hydrocarbon streams and waste lubricant materials are candidates for feedstock. Waste lubricants which are suitable for treatment by the process of the present invention may contain hydraulic fluids, heat transfer fluids, used lubricating oil, used cutting oils and used solvents. The first distillate hydrocarbon stream is introduced into the hydrogenation zone and may preferably be selected from the group consisting of atmospheric gas oil, vacuum gas oil and mixtures thereof. The second distillate hydrocarbon stream may be conveniently prepared by topping or by the atmospheric fractionation of a crude oil which is suitable for the production of various heavy distillate hydrocarbon streams such as, for example, atmospheric gas oil, vacuum gas oil, cracked FCC oil, coker oil and admixtures thereof. Many of the waste lubricant streams which are suitable for the present invention may contain non-distillable components which include, for example, organometallic compounds, inorganic metallic compounds, finely divided particulate matter and non-distillable hydrocarbonaceous compounds. The present invention is particularly advantageous when the non-distillable components comprise sub-micron particulate matter and the conventional techniques of filtration, centrifugation or distillation tend to be highly ineffective.

The presence of a non-distillable component including finely divided particulate matter in a waste lubricant feed to a hydrogenation zone greatly increases the difficulty of hydrogenation. A non-distillable component tends 1) to foul the hot heat-exchange surfaces which are used to heat the feed to hydrogenation conditions; 2) to form coke or, in some other manner, deactivate the hydrogenation catalyst thereby shortening its active life; and 3) to otherwise hinder a smooth and facile hydrogenation operation. Particulate matter in a feed stream tends to deposit within the hydrogenation zone and to plug a fixed hydrogenation catalyst bed thereby abbreviating the time on stream.

In accordance with the present invention, a waste lubricant stream is contacted with a hot hydrogen-rich gaseous stream having a temperature greater than the waste lubricant stream in a flash zone at flash conditions thereby increasing the temperature of the waste lubricant stream and vaporizing at least a portion thereof to provide a hydrocarbonaceous vapor stream comprising hydrogen and a heavy non-distillable product. The hot hydrogen-rich gaseous stream preferably comprises more than about 70 mol percent hydrogen and preferably more than about 90 mol percent hydrogen. In a preferred embodiment, the hot hydrogen-rich gaseous stream is comprised of a recycle hydrogen gas stream which is recovered downstream of the hydrogenation reaction zone. The hot hydrogen-rich gaseous stream is multi-functional and serves as 1) a heat source used to directly heat the waste lubricant stream to preclude the coke formation that could otherwise occur when using an indirect heating apparatus such as a heater or heat-exchanger; 2) a diluent to reduce the partial pressure of the hydrocarbonaceous compounds during vaporization in the flash zone; 3) a possible reactant to minimize the formation of hydrocarbonaceous polymers at elevated temperatures; 4) a stripping medium; and 5) at least a portion of the hydrogen required in the hydrogenation reaction zone. In accordance with the present invention the waste lubricant stream containing a non-distillable component is preferably maintained at a temperature less than about 482° F. (250° C.) before being introduced into the flash zone in order to prevent or minimize the thermal degradation of the feed stream. Depending upon the characteristics and composition of the waste lubricant stream, the hot hydrogen-rich gaseous stream is introduced into the flash zone at a temperature greater than the waste lubricant stream and preferably at a temperature from about 200° F. (93° C.) to about 1200° F. (649° C.).

Once the waste lubricant stream containing a non-distillable component is separated into a distillable hydrocarbonaceous stream and a heavy non-distillable product, the resulting distillable hydrocarbonaceous stream is introduced into a hydrogenation zone. A first distillate hydrocarbon stream is also introduced into the hydrogenation zone. If the feed stream contains metallic compounds such as those that contain metals such as zinc, copper, iron, barium, phosphorus, magnesium, aluminum, lead, mercury, cadmium, cobalt, arsenic, vanadium, chromium, and nickle, these compounds will be isolated in the relatively small volume of recovered non-distillable product which may then be immobilized in an asphalt matrix, treated for metals recovery or otherwise disposed of as desired. In the event that the waste lubricant stream contains distillable hydrocarbonaceous compounds which include sulfur, oxygen, nitrogen, metal or halogen components, the resulting recovered distillable hydrocarbonaceous stream is hydrogenated to remove or convert such components as desired. In the present invention, the hydrogenation of the resulting distillable hydrocarbonaceous stream is conducted immediately without intermediate separation or condensation. The advantages of the integrated process of the present invention will be readily apparent to those skilled in the art and include the economy of greatly reduced utility costs and reagents.

The flash zone is preferably maintained at flash conditions which include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 60,000 SCFB (10,110 normal $m^3/m^3$) based on the waste lubricant feed stream to the flash zone and an average residence time of the hydrogen-containing, hydrocarbonaceous vapor stream in the flash zone from about 0.1 seconds to about 50 seconds. A more preferred average residence time of the hydrogen-containing hydrocarbonaceous vapor stream in the flash zone is from about 1 second to about 10 seconds.

The resulting heavy non-distillable portion of the waste lubricant stream is removed from the bottom of the flash zone as required to yield a heavy non-distillable product stream. The heavy non-distillable product may contain a relatively small amount of distillable component, but since essentially all of the non-distillable components contained in the waste lubricant feed stream are recovered in this product stream, the term "heavy non-distillable product" is nevertheless used for the convenient description of this product stream. The heavy non-distillable product preferably contains a distillable component of less than about 10 wt. % and more preferably less than about 5 wt. %. In one embodiment, any metal values may be recovered from the residue.

The resulting hydrogen-containing hydrocarbonaceous vapor stream is removed from the flash zone and introduced into a catalytic hydrogenation zone containing hydrogenation catalyst and maintained at hydrogenation conditions. A first distillate hydrocarbon stream is also introduced into the hydrogenation zone and may comprise from about 1 weight percent to about 99 weight percent of the organic compounds introduced into the catalytic hydrogenation zone. The catalytic hydrogenation zone may contain a fixed, ebullated or fluidized catalyst bed. This reaction zone is preferably maintained under an imposed pressure from about atmospheric (0 kPa gauge) to about 2000 psig (13790 kPa gauge) and more preferably under a pressure from about 100 psig (689.5 kPa gauge) to about 1800 psig (12411 kPa gauge). Suitably, such reaction is conducted with a maximum catalyst bed temperature in the range of about 122° F. (50° C.) to about 850° F. (454° C.) selected to perform the desired hydrogenation conversion and reduce or eliminate the undesirable characteristics or components of the hydrocarbonaceous vapor stream. In accordance with the present invention, it is contemplated that the desired hydrogenation conversion includes, for example, dehalogenation, desulfurization, denitrification, olefin saturation, oxygenate conversion and hydrocracking. Further preferred operating conditions include liquid hourly space velocities in the range from about 0.05 $hr^{-1}$ to about 20 $hr^{-1}$ and hydrogen circulation rates from about 200 standard cubic feet per barrel (SCFB) (33.71 normal $m^3/m^3$) to about 70,000 SCFB (11,796 normal $m^3/m^3$), preferably from about 300 SCFB (50.6 normal $m^3/m^3$) to about 20,000 SCFB (3371 normal $m^3/m^3$).

In the event that the temperature of the hydrogen-containing hydrocarbonaceous stream which is removed from the flash zone is not deemed to be exactly the temperature selected to operate the catalytic hydrogenation zone, it is contemplated that the temperature of the hydrogen-containing, hydrocarbonaceous stream may be adjusted either upward or downward in order to achieve the desired temperature in the catalytic hydrogenation zone. Such a temperature adjustment may be accomplished, for example, by the addition of either cold or hot hydrogen.

The preferred catalytic composite disposed within the hereinabove-described hydrogenation zone can be characterized as containing a metallic component having hydrogenation activity, which component is combined with a suitable refractory inorganic oxide carrier material of either synthetic or natural origin. The precise composition and method of manufacturing the carrier material are not considered essential to the present invention. Preferred carrier materials are alumina, silica and mixtures thereof. Suitable metallic components having hydrogenation activity are those selected from the group comprising the metals of Groups VIB and VIII of the Periodic Table, as set forth in the *Periodic Table of the Elements*, E.H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically-active metallic component, or components, is primarily dependent upon a particular metal as well as the physical and/or chemical characteristics of the particular hydrocarbon feedstock. For example, the metallic components of Group VIB are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating middle distillate hydrocarbonaceous compounds to remove nitrogen and sulfur may function effectively in the hydrogenation zone of the present invention. It is further contemplated that hydrogenation catalytic composites may comprise one or more of the following components: cesium, francium, lithium, potassium, rubidium, sodium, copper, gold, silver, cadmium, mercury and zinc.

The hydrocarbonaceous effluent from the hydrogenation zone is preferably partially condensed in a hot separator. The liquid bottoms stream from the hot separator produces one of the distillate product streams. The resulting vapor phase is then contacted with an aqueous, ammoniacal scrubbing solution from the integrated hydrocracking zone and the admixture is cooled and admitted to a separation zone in order to separate a spent aqueous stream, a hydrogenated hydrocarbonaceous liquid phase and a hydrogen-rich gaseous phase. The contact of the hydrocarbonaceous effluent from the hydrogenation zone with the aqueous, ammoniacal scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 100 volume percent based on the hydrocarbonaceous effluent from the hydrogenation zone. The aqueous scrubbing solution is an aqueous ammonia solution produced in the integrated hydrocracking zone. The aqueous ammonia solution is used to neutralize the acid gas such as hydrogen chloride, hydrogen bromide and hydrogen fluoride, for example, which is formed during the hydrogenation of the feed. The resulting hydrogenated hydrocarbonaceous liquid phase is recovered and the hydrogen-rich gaseous phase may be recycled to the hydrogenation zone and/or to the flash zone if desired.

The resulting hydrogenated hydrocarbonaceous liquid phase is preferably recovered from the hydrogen-rich gaseous phase in a separation zone which is maintained at essentially the same pressure as the hydrogenation reaction zone and, as a consequence, contains dissolved hydrogen and low molecular weight normally gaseous hydrocarbons, if present. In accordance with the present invention, it is preferred that the hydrogenated hydrocarbonaceous liquid phase comprising the hereinabove-mentioned gases be stabilized in a convenient manner, such as, for example, by stripping or flashing, to remove the normally gaseous components to provide a stable hydrogenated distillable hydrocarbonaceous stream which is recovered as a product stream. A liquid bottoms stream is removed from the hot separator to provide one of the distillate product streams.

In accordance with the integrated process of the present invention, a second distillate hydrocarbon stream is introduced into a hydrocracking zone at hydrocracking conditions. Preferably, the hydrocracking zone contains a catalyst which comprises, in general, a cracking base such as a crystalline zeolite, for example, upon which is deposited a minor proportion of a Group VIII metal hydrogenating component. Additional hydrogenating components may be selected from Group VIB for incorporation with the catalyst base or support material. Any suitable support material for a hydrocracking catalyst is contemplated for use in the present invention. The composition or the method of preparation of the hydrocracking catalyst is not deemed to be a critical feature of the present invention.

The active metals employed in the preferred catalysts of the present invention as hydrogenation components are those of Group VIII, i.e., iron, cobalt, nickel, ruthenium, rhodium, palladium, osmium, iridium, and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the support material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like, if desired, and calcined in air at temperatures of, e.g., 700°–1200° F. (371°–648° C.) in order to activate the catalyst. Alternatively, the support material may be first pelleted, followed by the addition of the hydrogenating component and activation by calcining. The foregoing catalysts may be employed in undiluted form, or may be mixed and copelleted with other catalysts, diluents or binders such as alumina, silica gel, silica-alumina cogels, activated clays and the like.

Additional metal-promoted hydrocracking catalysts may also be utilized in the process of the present invention which comprises, for example, aluminophosphate molecular sieves, crystalline chromosilicates and other crystalline silicates.

The hydrocracking is conducted in the presence of hydrogen and preferably at hydrocracking conditions which include a temperature from about 450° F. (232° C.) to about 850° F. (454° C.), a pressure from about 500 psig (3448 kPa gauge) to about 3000 psig (20685 kPa gauge), a liquid hourly space velocity (LHSV) from about 0.2 to about 20 $hr^{-1}$ and a hydrogen circulation rate from about 2000 (355 std $m^3/m^3$) to about 10,000 (1778 std $m^3/m^3$) standard cubic feet per barrel.

During the catalytic hydrocracking of the second distillate hydrocarbon feedstock, ammonia is produced as a by-product during the conversion of the feedstock which contains nitrogen. The effluent from the hydrocracking zone is contacted with an aqueous solution or water to remove the ammonia from the effluent stream. This resulting aqueous, ammoniacal solution is utilized to neutralize the acid gas which is produced in the integrated hydrogenation reaction zone as described hereinabove.

DETAILED DESCRIPTION OF THE DRAWING

In the drawing, the process of the present invention is illustrated by means of a simplified flow diagram in which such details as the total number of reaction zone vessels, pumps, instrumentation, heat exchange and heat-recovery circuits, compressors and similar hardware have been deleted as being non-essential to an understanding of the techniques involved. The use of such miscellaneous appurtenances are well within the purview of one skilled in the art.

With reference now to the drawing, a waste oil feed stream is introduced into the process via conduit 1 and is contacted with a hot gaseous hydrogen-rich stream which is provided via conduit 19 and the waste oil is flashed in feed separation zone 2. A hydrocarbonaceous vapor stream comprising hydrogen is removed from feed separation zone 2 via conduit 4, is admixed with an atmospheric gas oil feed stream which is introduced via conduit 5 and the resulting admixture is introduced into hydrogenation reaction zone 6 without intermediate separation thereof. A heavy non-distillable stream is removed from feed separation zone 2 via conduit 3 and recovered. A stream containing hydrogenated distillable hydrocarbonaceous compounds is removed from hydrogenation reaction zone 6 via conduit 7 and introduced into hot separator 8. A heavy hydrocarbonaceous product stream is recovered from hot separator 8 via conduit 9. A gaseous hydrocarbonaceous stream containing hydrogen is removed from hot separator 8 via conduit 10 and is admixed with an aqueous ammonia solution which is provided via conduit 26 and the resulting admixture is cooled in heat exchanger 11 and is introduced via conduit 12 into cold separator 13. A spent aqueous scrubbing solution is removed from cold separator 13 via conduit 14 and recovered. A liquid hydrocarbon product stream is removed from cold separator 13 via conduit 15 and recovered. A hydrogen-rich gaseous stream is removed from cold separator 13 via conduit 16 and is passed into amine scrubber 17. A stream rich in hydrogen sulfide which has been scrubbed from the hydrogen-rich gaseous stream is removed from amine scrubber 17 via conduit 18 and recovered. A hydrogen-rich gaseous stream having a reduced concentration of hydrogen sulfide is removed from amine scrubber 17 via conduit 19, is passed into heat exchanger 20 for heating and is introduced via conduit 19 into the waste oil feed stream as hereinabove described. A vacuum gas oil feedstock is introduced into the process via conduit 22 and enters hydrocracking zone 23. A hydrogen-rich gaseous stream is introduced via conduit 21 into hydrocracking zone 23 and an aqueous wash water stream is introduced via conduit 24 into hydrocracking zone 23. A hydrocarbon product stream is removed from hydrocracking zone 23 via conduit 25 and recovered. A sour water stream containing ammonia is removed from hydrocracking zone 23 via conduit 26 and is utilized as described hereinabove.

The process of the present invention is further demonstrated by the following illustrative embodiment. This illustrative embodiment is, however, not presented to unduly limit the process of this invention, but to further illustrate the advantages of the hereinabove-described embodiments. The following data were not completely obtained by the actual performance of the present invention, but are considered prospective and reasonably illustrative of the expected performance of the invention.

ILLUSTRATIVE EMBODIMENT

A waste lube oil having the characteristics presented in Table 1 and contaminated with 20 ppm by weight of polychlorinated biphenyl (PCB) is charged at a rate of 100 mass units per hour to a hot hydrogen flash separation zone. The hot hydrogen is introduced into the hot hydrogen flash separation zone at a rate of 31 mass units per hour.

TABLE 1

| WASTE LUBE OIL FEEDSTOCK PROPERTIES | | |
|---|---|---|
| Specific Gravity @ 60° F. (15° C.) | 0.8827 | |
| Vacuum Distillation Boiling Range, (ASTM D-1160) | °F. | (°C.) |
| IBP | 338 | (170) |
| 10% | 516 | (269) |
| 20% | 628 | (331) |
| 30% | 690 | (367) |
| 40% | 730 | (388) |
| 50% | 750 | (399) |
| 60% | 800 | (421) |
| 70% | 831 | (444) |
| 80% | 882 | (474) |
| % Over | 80 | |
| % Bottoms | 20 | |
| Sulfur, weight percent | 0.5 | |
| Polychlorinated Biphenyl Concentration, wppm | 20 | |
| Lead, wppm | 863 | |
| Zinc, wppm | 416 | |
| Cadmium, wppm | 1 | |
| Copper, wppm | 21 | |
| Chromium, wppm | 5 | |

The waste lube oil is preheated to a temperature of less than 482° F. (250° C.) before introduction into the hot hydrogen flash separation zone which temperature precludes any significant detectable thermal degradation. The waste lube oil is intimately contacted in the hot flash separation zone with a hot hydrogen-rich gaseous stream having a temperature upon introduction into the hot hydrogen flash separation zone of greater than 748° F. (398° C.). In addition, the hot hydrogen flash separation zone is operated at conditions which included a temperature of 788° F. (420° C.), a pressure of 810 psig (5585 kPa gauge), a hydrogen circulation rate of 18,000 SCFB (3034 normal $m^3/m^3$) based on the waste lube oil and an average residence time of the vapor stream of 5 seconds.

A hydrocarbonaceous vapor stream comprising hydrogen is recovered from the hot hydrogen flash separation zone, is admixed with 200 mass units of atmospheric gas oil having the characteristics presented in Table 2 and the resulting admixture is directly introduced without separation into a hydrogenation reaction zone containing a hydrogenation catalyst comprising alumina, nickel and molybdenum. Properties of the C7+ fraction of the hydrocarbonaceous vapor stream entering the reaction zone are presented in Table 3. The hydrogenation reaction is conducted with a catalyst peak temperature of 662° F. (350° C.), a pressure of 800 psig (5516 kPa gauge), a liquid hourly space velocity of 0.5 based on hydrocarbon feed to the hydrogenation reaction zone and a hydrogen to oil ratio of 20,000 SCFB (3370 normal $m^3/m^3$). The hydrogenated effluent from the hydrogenation reaction zone, including small quantities of hydrogen chloride, is passed into a hot separator to produce a heavy hydrocarbonaceous stream and a gaseous stream containing hydrogen, hydrogen chloride, hydrogen sulfide and lower molecular weight hydrocarbons which gaseous stream is contacted with an aqueous ammonia scrubbing solution, cooled to about 100° F. (38° C.), and sent to a vapor-liquid separator wherein a gaseous hydrogen-rich stream is separated from the normally liquid hydrocarbonaceous phase and spent aqueous scrubbing solution containing sulfide and chloride ions. The resulting gaseous hydrogen-rich stream is passed through an amine scrubber to remove sulfur compounds and is then compressed and admixed with a fresh supply of hydrogen in an amount sufficient to maintain the hydrogenation reaction zone pressures. The resulting normally liquid hydrocarbonaceous phase is recovered.

TABLE 2

| PROPERTIES OF ATMOSPHERIC GAS OIL | | |
|---|---|---|
| Specific Gravity @ 60° F. (15° C.) | 0.8745 | |
| Distillation Boiling Range, (ASTM D-86) | °F. | (°C.) |
| 5% | 465 | (240) |
| 10% | 489 | (254) |
| 50% | 548 | (287) |
| 90% | 641 | (338) |
| 95% | 664 | (351) |
| FBP | 672 | (356) |
| % Over | 98 | |
| Sulfur, weight percent | 1.0 | |
| Nitrogen, weight ppm | 150 | |
| Pour Point, °F. | −20 | |

TABLE 3

| PROPERTIES OF C7+ FRACTION OF HYDROCARBONACEOUS VAPOR STREAM | | |
|---|---|---|
| Specific Gravity @ 60° F. (15° C.) | 0.866 | |
| Vacuum Distillation Boiling Range, (ASTM D-1160) | °F. | (°C.) |
| IBP | 225 | (107) |
| 10% | 433 | (223) |
| 20% | 538 | (280) |
| 30% | 633 | (334) |
| 40% | 702 | (372) |
| 50% | 741 | (394) |
| 60% | 770 | (410) |

TABLE 3-continued

| PROPERTIES OF C7+ FRACTION OF HYDROCARBONACEOUS VAPOR STREAM | | |
|---|---|---|
| 70% | 801 | (427) |
| 80% | 837 | (447) |
| 90% | 896 | (479) |
| 95% | 943 | (506) |
| EP | 982 | (527) |
| % Over | 97 | |
| % Bottoms | 3 | |
| Sulfur, weight percent | 0.31 | |
| Polychlorinated Biphenyl Concentration, wppm | 22 | |
| Lead, wppm | 3.7 | |
| Zinc, wppm | 1.5 | |
| Cadmium, wppm | <0.04 | |
| Copper, wppm | 0.1 | |
| Chromium, wppm | 0.6 | |

A non-distillable liquid stream is recovered from the bottom of the flash separation zone in an amount of 10 mass units per hour and having the characteristics presented in Table 4.

TABLE 4

| ANALYSIS OF NON-DISTILLABLE STREAM | |
|---|---|
| Specific Gravity @ 60° F. (15° C.) | 1.0 |
| Polychlorinated Biphenyl Concentration, wppm | <0.2 |

A vacuum gas oil in an amount of 300 mass units per hour and having the characteristics presented in Table 5 is introduced into a hydrocracking zone to produce a lower boiling hydrocarbon product stream in an amount of 270 mass units. An aqueous ammonia solution in an amount of about 15 mass units per hour and containing 3 weight percent ammonia is recovered from the hydrocracking zone and is admixed with an effluent stream from the hydrogenation reaction zone as described hereinabove.

TABLE 5

| ANALYSIS OF VACUUM GAS OIL | | |
|---|---|---|
| Specific Gravity @ 60° F. (15° C.) | 0.925 | |
| Vacuum Distillation Boiling Range, (ASTM D- 1 160) | °F. | (°C.) |
| IBP | 600 | (315) |
| 50% | 800 | (427) |
| EP | 1000 | (538) |
| % Over | 98 | |
| % Bottoms | 2 | |
| Sulfur, weight percent | 2.0 | |
| Nitrogen, weight ppm | 1500 | |
| Pour Point, °F. | +80 | |

The foregoing description, drawing and illustrative embodiment clearly demonstrate the advantages encompassed by the process of the present invention and the benefits to be afforded with the use thereof.

What is claimed:

1. An integrated process for the production of a distillable hydrocarbon stream from a first distillate hydrocarbon stream, a second distillate hydrocarbon stream and a waste lubricant stream which process comprises:

(a) contacting said waste lubricant stream with a first hydrogen-rich gaseous stream in a flash zone at flash conditions thereby increasing the temperature of said waste lubricant stream to produce a hydrocarbonaceous vapor stream comprising hydrogen and a non-distillable component;

(b) admixing said hydrocarbonaceous vapor stream comprising hydrogen and said first distillate hydrocarbon feed stream and contacting the resulting admixture with a hydrogenation catalyst in a hydrogenation reaction zone at hydrogenation conditions;

(c) condensing at least a portion of the resulting effluent from said hydrogenation reaction zone to produce a second hydrogen-rich gaseous stream comprising at least one acid gas and a first distillable hydrocarbon product stream;

(d) contacting said second distillate hydrocarbon stream with a hydrocracking catalyst in a hydrocracking zone at hydrocracking conditions;

(e) recovering a second distillable hydrocarbon product stream and an aqueous ammonia solution from said hydrocracking zone;

(f) admixing said aqueous ammonia solution recovered in step (e) with said second hydrogen-rich gaseous stream comprising at least one acid gas recovered from step (c);

(g) condensing at least a portion of the admixture produced in step (f) to produce a third hydrogen-rich gaseous stream and a third distillable hydrocarbon product stream; and (h) recycling at least a portion of said third hydrogen-rich gaseous stream from step (g) to step (a).

2. The process of claim 1 wherein said waste lubricant contains halogenated hydrocarbons.

3. The process of claim 1 wherein said acid gas is selected from the group consisting of hydrogen sulfide, hydrogen halide and mixtures thereof.

4. The process of claim 1 wherein said waste lubricant stream comprises a component selected from the group consisting of hydraulic fluids, heat transfer fluids, used lubricating oil, used cutting oils and used solvents.

5. The process of claim 1 wherein said first distillate hydrocarbon stream is selected from the group consisting of atmospheric gas oil, vacuum gas oil and mixtures thereof.

6. The process of claim 1 wherein said second distillate hydrocarbon stream is selected from the group consisting of atmospheric gas oil, vacuum gas oil, cracked FCC oil, coker oil and mixtures thereof.

7. The process of claim 1 wherein said waste lubricant stream comprises a non-distillable component selected from the group consisting of organometallic compounds, inorganic metal compounds, finely divided particulate matter and non-distillable hydrocarbonaceous compounds.

8. The process of claim 1 wherein said waste lubricant stream is introduced into said flash zone at a temperature less than about 482° F.

9. The process of claim 1 wherein the temperature of said first hydrogen-rich gaseous stream is from about 200° F. to about 1200° F.

10. The process of claim 1 wherein said flash conditions include a temperature from about 150° F. to about 860° F. a pressure from about atmospheric to about 2000 psig, a hydrogen circulation rate of about 1000 SCFB to about 60,000 SCFB based on said first feedstock, and an average residence time of said hydrocarbonaceous vapor stream comprising hydrogen in said flash zone from about 0.1 seconds to about 50 seconds.

11. The process of claim 1 wherein said hydrogenation reaction zone is operated at conditions which include a pressure from about atmospheric to about 2000 psig, a maximum catalyst temperature from about 122° F. to about 850° F. and a hydrogen circulation rate from about 200 SCFB to about 70,000 SCFB.

12. The process of claim 1 wherein said hydrogenation catalyst comprises a refractory inorganic oxide and at least one metallic compound having hydrogenation activity.

13. The process of claim 12 wherein said metallic compound is selected from the metals of Group VIB and VIII of the Periodic Table.

* * * * *